US005991718A

United States Patent [19]

Malah

[11] Patent Number: 5,991,718

[45] Date of Patent: Nov. 23, 1999

[54] SYSTEM AND METHOD FOR NOISE THRESHOLD ADAPTATION FOR VOICE ACTIVITY DETECTION IN NONSTATIONARY NOISE ENVIRONMENTS

[75] Inventor: David Malah, Kiryat-Chayim, Israel

[73] Assignee: AT&T Corp., New York, N.Y.

[21] Appl. No.: 09/031,726

[22] Filed: Feb. 27, 1998

[51] Int. Cl.[6] ..... G10L 9/00

[52] U.S. Cl. ..... 704/233; 704/226; 704/214; 704/208

[58] Field of Search ..... 704/214, 226, 704/233, 208

[56] References Cited

U.S. PATENT DOCUMENTS

| | | | |
|---|---|---|---|
| 4,696,039 | 9/1987 | Doddington | 704/215 |
| 4,696,040 | 9/1987 | Doddington et al. | 704/234 |
| 5,459,814 | 10/1995 | Gupta et al. | 704/233 |
| 5,706,394 | 1/1998 | Wynn | 704/219 |
| 5,749,067 | 5/1998 | Barrett | 704/233 |

OTHER PUBLICATIONS

Voice Activity Detection, GSM 06.32 Version 3.0.0, European Telecommunications Standards Institute, 1991.

ITU–T, Annex A to Recommendation G. 723.1: Silence Compression Scheme for Dual Rate Speech Coder for Multimedia Communications Transmitting at 5.3 & 6.3Kbit/s, May 1996.

ITU–T, G.729A: A Proposal for a Silence Compression Scheme Optimized for the ITU–TG. 729 Annex A Speech Coding Algorithm, by France Telecom/CNET, Jun. 1996.

R. Tucker, "Voice Activity Detection using a Periodicity Measure", IEEE Proceedings–I, vol. 139, No. 4, pp. 377–380, Aug. 1992.

E. Paksoy, K. Srinivasan, and A. Gersho, "Variable Rate Speech Coding with Phonetic Segmentation," ICASSP93, Minneapolis, pp. II–155 –II–158, 1993.

K. El–Maleh and P. Kabal, Comparsion of Voice Activity Detection Algorithms for Wireless Personal Communications Systems, IEEE Canadian Conference on Electrical and Computer Engineering, pp. 470–473, May 1997.

*Primary Examiner*—David R. Hudspeth
*Assistant Examiner*—Abul K. Azad

[57] ABSTRACT

The system and method of the invention relates to voice detection technology for determining instants of time at which a snapshot of noise characteristics results in improved adaptation of noise floors used in voice detection. The approach is based on the "lower envelope" of the smoothed input signal power. Incorporation of this approach in a simple time domain VAD (Voice Activity Detector) results in an effective low-complexity system which, on the basis of simulations, gives good performance down to SNR values of about 0 dB. In the invention the lower envelope also provides the updated value of the noise threshold during the presence of speech. The invention can also be embedded in other, more complex (e.g., frequency domain) VADs at low computational cost.

22 Claims, 9 Drawing Sheets

SYSTEM AND METHOD FOR NOISE THRESHOLD ADAPTATION FOR VOICE ACTIVITY DETECTION IN NONSTATIONARY NOISE ENVIRONMENTS

BACKGROUND OF THE INVENTION

1. Field of Invention

The invention relates to voice detection technology, and more particularly to estimation of noise floors to aid in voice discrimination.

2. Description of Related Art

Voice Activity Detectors (VADs) are an important component in speech coding systems which make use of the natural silence periods in the speech signal to increase transmission efficiency. They are also an essential part of most speech enhancement systems, since in these systems the input noise level and spectral shape are typically measured and updated in only those segments which contain noise only.

VAD information is useful in other applications as well, such as streamlining speech packets on the Internet by compensating for network delays at gaps in speech activity, or detecting end points of speech utterances under noisy conditions in speech recognition tasks.

In most of these applications the background noise is not always stationary. In a hands-free mobile telephone system for instance both car and road noise may change quickly. The VAD therefore has to adapt quickly to the varying noise conditions to provide an accurate indication of noise-only segments. Since the speech signal itself is also not stationary, this task is usually not a simple one. Several VAD algorithms and adaptation methods have been reported in recent years, some of them being part (or in the process of being standardized as part) of standard speech coding systems known in the art. However, these VADs are complicated, and leave room for improvements, both in terms of performance and complexity, particularly for applications other than speech coding.

SUMMARY OF THE INVENTION

The invention overcoming these and other problems in the art relates to a system and method for noise threshold adaptation for voice detection based in part on the observation that the background noise level can be updated even during short silence intervals in the speech signal, by tracking a parameter termed a "lower envelope" of the input signal. For simplicity the invention is described as part of a low-complexity time-domain VAD, which is found to work well down to SNR values of about 0 dB. It will however be understood that the invention can be embedded in more complex VADs capable of providing good performance even at lower SNR values.

BRIEF DESCRIPTION OF THE DRAWINGS

The invention will be described with reference to the following drawings, in which like elements are designated by like numbers and in which.

DETAILED DESCRIPTION OF THE DRAWINGS

Figure 1:
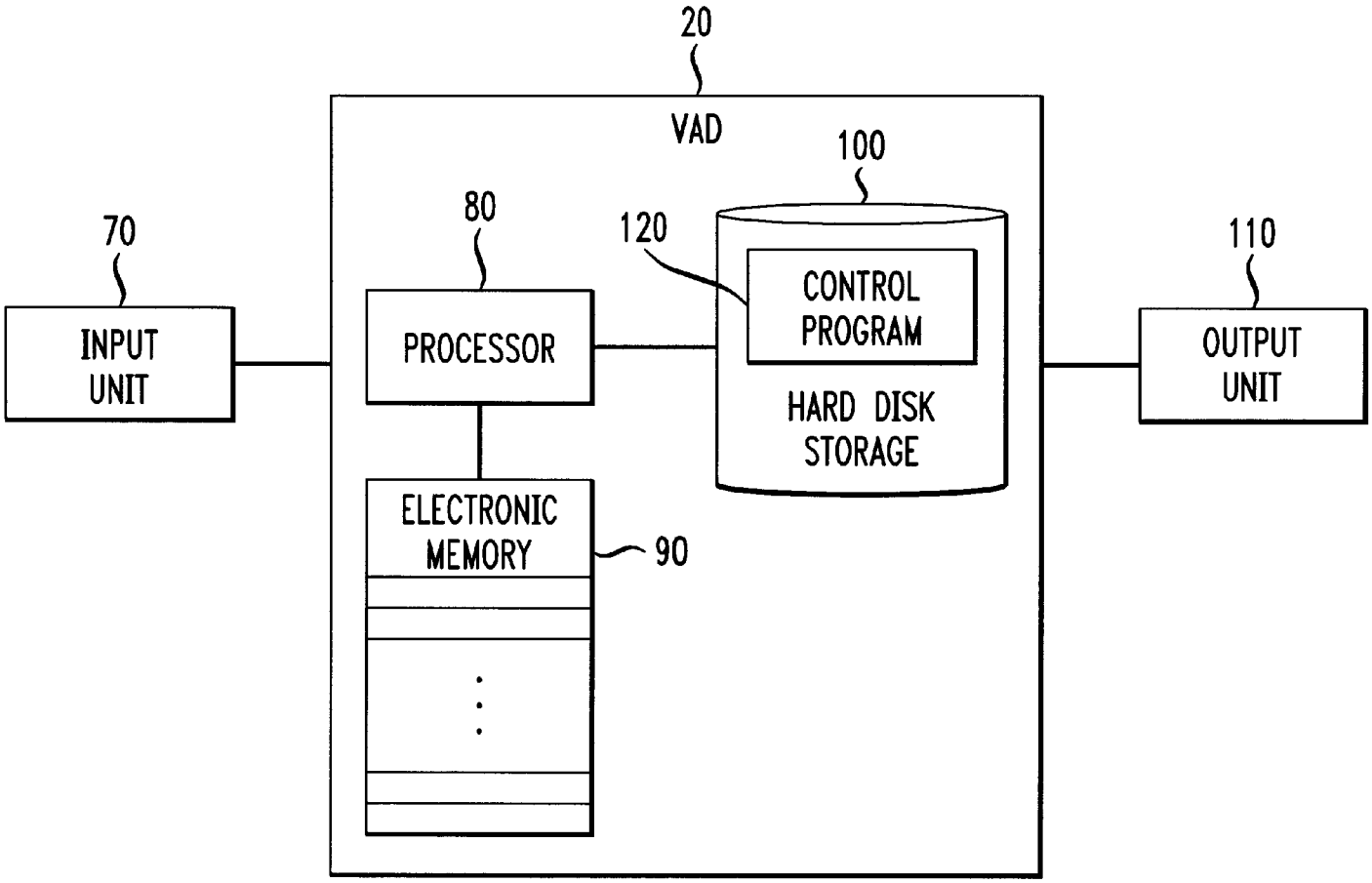
FIG. 1 illustrates a schematic block diagram of a VAD system according to the invention.

A. Low Complexity Time-Domain VAD with which the Invention Illustratively Operates To demonstrate the system and method of the invention a low complexity time domain VAD implementation is first described, in conjunction with which the invention operates, as illustrated in FIG. 1. VAD 20 includes a processor 80 connected to electronic memory 90 and hard disk storage 100 on which is stored control program 120 to carry out computational and other aspects of the invention. VAD 20 is connected to an input unit 70 which may be a microphone or other source of input signals, and to output unit 110 which may include an audible output unit or digital signal processing or other circuitry. For each input signal segment of length $N_{seg}$, the VAD 20 makes a decision whether speech is present (V=1), or not (V=0). The decision is made by comparing the power level of the signal in each segment to a given threshold. However, since the noise power is expected to vary, the threshold must be adapted to the noise level.

Let $\lambda_m$ denote the noise power in the mth segment and $Y_m$ the input noisy signal power in that segment, i.e., $$Y_m = \frac{1}{N_{seg}} \sum_{n=1}^{N_{seg}} y_m^2(n), \qquad \text{Equation 1}$$

where $y_m(n)$ is the n-th input signal sample in the m-th segment, which can be written under an additive noise assumption as:

$$y_m(n)=x_m(n)+v_m(n), \qquad \text{Equation 2}$$

where x denotes the clean speech signal and v is the noise.

One could then decide that speech is present in the mth segment if $Y_m > \lambda_m$, where $\lambda_m$ is the estimated noise power for that segment. However, since even if the noise is stationary, a short-term estimate of its power (when speech is absent) would fluctuate from segment to segment, one should use a somewhat higher threshold value than $\lambda_m$ to avoid too frequent false decisions that speech is present. Hence the noise threshold value, $Th_\lambda(m)$ to which $Y_m$ is compared is chosen to be $$Th_\lambda(m)=b_\lambda\lambda_m, b_\lambda>1, \quad \text{Equation 3}$$

where $b_\lambda$ is a bias factor to account for this effect. Too large a bias factor may cause the VAD to decide that speech is absent (V=0) at low speech levels (e.g., unvoiced speech), so $b_\lambda$ is typically limited to values below 2. Values in the range of 1.1 to 1.6, adapted to the noise level, have been used.

Furthermore, since $Y_m$ may also exhibit undesired fluctuations from segment to segment, particularly when the segments are short, smoothing of the short term input power is done by the following recursive relation:

$$Y_m^s=\alpha_Y Y_{m-1}^s+(1-\alpha_Y)Y_m \quad \text{Equation 4}$$

where $0<\alpha_y<1$ is a smoothing factor, and $Y_m^s$ is the smoothed short-term input power.

Thus, the VAD decision rule is:

$$V=1 \text{ (speech present) if } Y_m^s>Th_\lambda(m)$$

$$V=0 \text{ (noise only) if } Y_m^s\leqq Th_\lambda(m) \quad \text{Equation 5}$$

Since the power of a typical speech utterance decreases slowly at its end (as compared to the typically fast onset of speech), it is customary in the art to keep the decision V=1 for a few more segments following the end of an utterance (a technique known as "hangover"). This avoids clipping (when V is considered as a gain function) of the tail of the utterance, which could result from deciding V=0 too soon. When designing a VAD one should then generally set a value for the hangover interval, $T_{hngovr}$, which determines the corresponding number of hangover-segments, $L_{hngovr}$, via the relation $L_{hngovr}=\lfloor T_{hngovr}/T_{step}\rfloor$ where $T_{step}$ is the duration of the segment update interval.

Since the decision in Equation (5) is based on the smoothed input power $Y_m^s$, there is already a natural hangover because of the smoothing. Hence, $T_{hngovr}$ is initially limited to less than 0.1 sec. $T_{hngovr}$ can also be adapted to the noise level, as known in the art (see E. Paksoy, K. Srinivasan, and A. Gersho, "Variable Rate Speech Coding with Phonetic Segmentation," ICASSP-93, Minneapolis, pp. II-155–II-158, 1993, incorporated by reference), for instance by allowing it to vary from 64 msec to 192 msec. It is also common in the art (see ETSI-GSM Technical Specification: Voice Activity Detector, GSM 06.32 Version 3.0.0, European Telecommunications Standards Institute, 1991, incorporated by reference) to avoid a hangover if the condition V=1 prevails only for just a few segments before deciding V=0, since such a situation is attributed to a noise burst, too short to be considered a speech utterance. Such a burst detection mechanism is also preferably implemented in the VAD 20 used in the invention with the burst-interval $T_{burst}$ set to a maximum of 64 msec.

As the lower envelope approach of the invention is described, an indication is needed whether the decision V=1 is due to a hangover condition. A flag HNG is used to indicate this condition. Thus, HNG=1 when the VAD is in a hangover state, and HNG=0 when it is not.

A significant issue in nonstationary environments is estimating the noise power level as it varies from segment to segment. It is typically assumed in the art that the initial segments contain noise only, and hence they can be used to obtain an initial estimate of the noise power. Then, whenever the VAD's decision is that a segment does not contain speech (V=0), the noise level estimate is updated using recursive smoothing of the form:

$$\lambda_{m+1}=\alpha_\lambda\lambda_m+(1-\alpha_\lambda)Y_m \text{ if } V(m)=0 \quad \text{Equation 6}$$

It is kept unchanged if V(m)=1. cc, is a smoothing factor, $0<\alpha_\lambda<1$. V(m) is the value of the VAD decision for the m-th segment.

In the invention the recursion can be applied directly to the noise threshold (when speech is absent), namely by:

$$Th_\lambda(m+1)=\alpha_\lambda^{Th}Th_\lambda(m)+(1-\alpha_\lambda^{Th})b_\lambda Y_m^s \text{ if } V(m)=0 \quad \text{Equation 6}$$

where the smoothing factor $0<\alpha_\lambda^{Th}<1$ should be smaller than $\alpha_\lambda$ of Equation (6), since in Equation (7) an already smoothed version, $Y_m^s$, of the input signal power is used.

This approach for updating the noise level is effective when speech is absent and the noise level does not increase rapidly. However, even a relatively small increase in noise power (e.g., by a factor equal to the bias factor $b_\lambda$) during a speech utterance will cause the VAD 20 to miss the end of the utterance. VAD 20 will then continue to assume that speech is present until the noise level descends below $b_\lambda$ times the value it had before that utterance began. A decrease in noise level, even when speech is present, poses no significant problem since the VAD 20 can still detect the end of the utterance properly and the noise threshold will eventually decay to the lower noise level, through the application of Equation (7).

When a transition of the form of a relatively steep increase in noise level occurs, the noise threshold tracking of Equation (7) may fail, even if speech is absent. In this case the VAD 20 will interpret the change in level as an onset of speech (unless additional attributes of the signal are examined, like presence of pitch, rate of zero crossings, etc. as done in some more complex VADs known in the art, such as those reflected in: ETSI-GSM Technical Specification: Voice Activity Detector, GSM 06.32 Version 3.0.0, European Telecommunications Standards Institute, 1991; ITU-T, Annex A to Recommendation G.723.1: Silence Compression Scheme for Dual Rate Speech Coder for Multimedia Communications Transmitting at 5.3 & 6.3 Kbit/s, May 1996; ITU-T, G.729A: A Proposal for a Silence Compression Scheme Optimized for the ITU-T G.729 Annex A Speech Coding Algorithm, by France Telecom/CNET, June 1996; R. Tucker, "Voice Activity Detection using a Periodicity Measure", IEE Proceedings-I, Vol. 139, No. 4, pp. 377–380, August 1992, each incorporated by reference). Such a transition in noise level is typical in mobile communication environments (e.g., a passing truck, car acceleration, opening a window, turning on the air conditioner, etc.).

B. Power Stationarity Test

One way to alleviate the effect of such a transition on the VAD 20 (assuming that following the transition the noise level becomes stationary for a while) is to measure the short term power stationarity of the input over a long enough interval $T_{PS}$ (say, 1 sec). Since speech is not expected to be stationary over such a relatively long interval, that measurement can indicate the absence of speech. Thus, following the transition to a higher noise level, if the measured power within that test interval does not change much (say, by less than 2 or 3 dB), the input signal can be assumed to be noise only. The noise threshold can then be updated, followed by tracking according to Equation (7).

Before this approach is described, it should be noted that the examples presented are for a segment length of $N_{seg}=256$ samples at a sampling rate of $f_s=8$ KHz (i.e., a segment duration $T_{seg}=N_{seg}/f_s=32$ msec), and an update step, $N_{step}=T_{step}\ f_s=N_{seg}$ (i.e., no overlap between consecutive segments).

Figure 2:
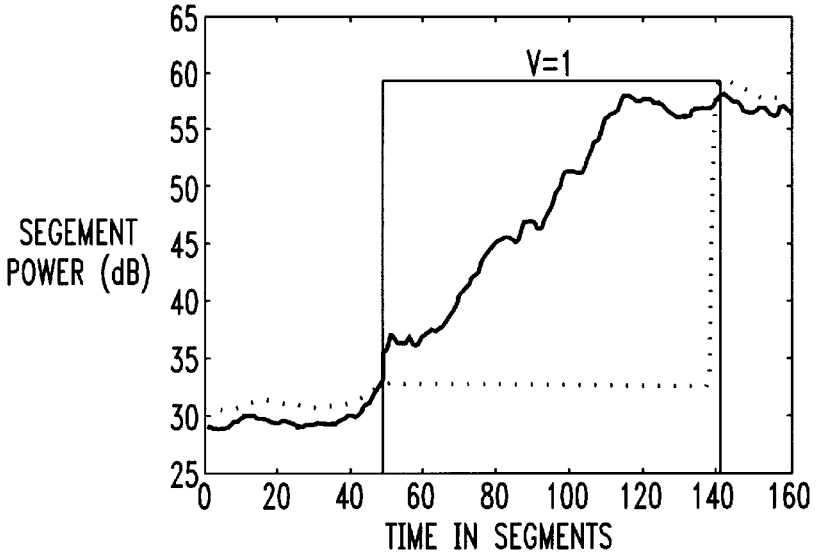
FIG. 2 illustrates use of the power stationarity test during a helicopter noise transition.
Figure 3:
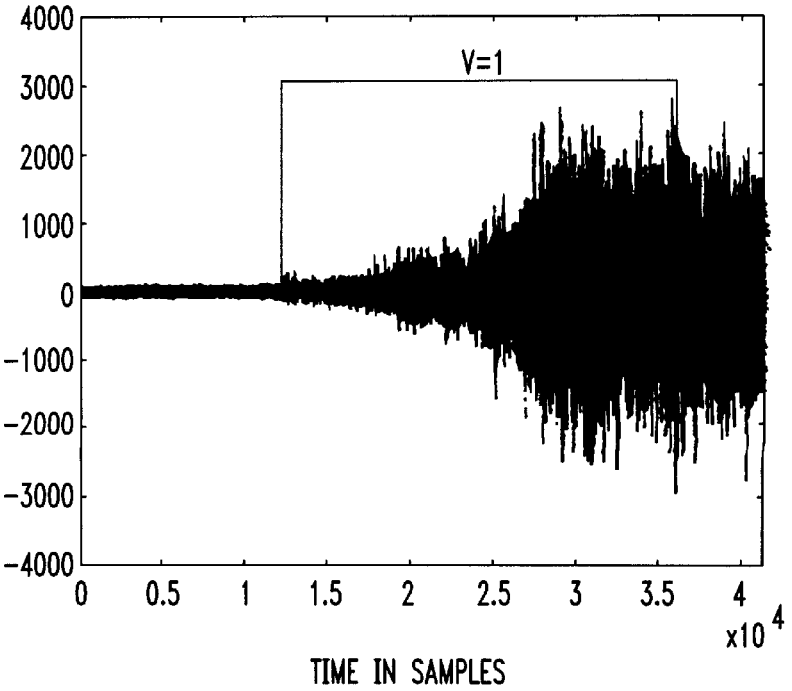
FIG. 3 illustrates a helicopter noise transition wave form with superimposed VAD decisions.

FIG. 2 demonstrates the use of this approach for a transition due to a steep increase of helicopter noise. In this figure the thin solid line describes the smoothed input power level, $Y_m^s$, (on a logarithmic scale) as it changes from segment to segment. The dotted line in this figure denotes the noise threshold, $Th_\lambda$, and the superimposed rectangular pulse defines the interval for which the VAD 20 makes the decision that speech is present (i.e., V=1, which is a wrong decision in this case). It is seen from the figure that the transition ends at about segment 110 and only about 32 segments after the transition has ended (the test interval, $T_{PS}$, is 1 sec long), at segment 142, the noise threshold is finally updated. Following this update the VAD 20 produces the correct decision V=0. The corresponding waveform is shown in FIG. 3, with decisions of VAD 20 superimposed.

Clearly this approach involves a delay of the duration of the noise transition from one level to another plus the duration of the power stationarity test interval (a total of about 100 segments (approx. 3 sec), in the example shown in FIG. 2).

The short term power stationarity test is implemented in the VAD 20 by first loading the values of $Y_m^w$ in a cyclic buffer ($B_Y$) 30 of length $L_{PS}=\lfloor T_{PS}/T_{step}\rfloor$ (an integer equal to the number of short term power measurements done in the test interval). Then, for each segment, the ratio between the largest and smallest data values present in buffer 30 are compared to a given threshold $Th_{PS}$. If this ratio is less than or equal to $Th_{PS}$, the power stationarity test is satisfied (PST=1); otherwise PST=0. In the example shown in FIGS. 2 and 3, $T_{SP}=1$ sec. ($L_{PS}=31$) and $Th_{PS}=1.6$ (2 dB). Formally, the equations which describe the power stationarity test (PS test) are as follows:

$$B_Y(k_s)=\max(Y_m^s,1),\ k_s=(m-1)\mathrm{mod}(L_{PS})+1;\quad 1\le k_s\le L_{PS} \qquad \text{Equation 8}$$

$$\frac{\max\limits_{1\le k_s\le L_{PS}}\{B_Y(k_s)\}}{\min\limits_{1\le k_s\le L_{PS}}\{B_Y(k_s)\}}\begin{cases}\le Th_{PS} & PS\text{-test satisfied} \quad (PST=1)\\ >Th_{PS} & PS\text{-test not satisfied} \quad (PST=0)\end{cases} \qquad \text{Equation 9}$$

The noise threshold is updated when the test result switches from PST=0 to PST=1 and speech is assumed present (V(m−1)=1), i.e., $$\text{if } \{PST(m-1)=0\ \&\ PST(m)=1\ \&\ V(m-1)=1\},\ \text{set } Th_\lambda(m)=b_\lambda Y_m^s \qquad \text{Equation 10}$$

To avoid numerical problems the minimum value allowed in the buffer 30 is 1 (according to Equation (8)). The maximum possible value in the buffer 30 is given by $$Y_{max}=2^{2(N_B-1)}, \qquad \text{Equation 11}$$

where $N_B$ is the number of bits in the input signal representation (16 bits in simulations by the Inventor). The buffer 30 must be initialized with 1's. It is also preferable to reset the buffer 30 every time the VAD 20 switches its decision.

It may be noted that the power stationarity test is actually a simplified form of a more elaborate test based on measuring spectral changes between consecutive segments, which is a central part of the more complex prior art VADs mentioned above. There is therefore a tradeoff between complexity and delay.

The power stationarity test known in the art and described above still does not solve the problem of tracking noise level increases which occur during and between closely spaced speech utterances, unless there are relatively long gaps between utterances (longer than the test interval) and the noise level is stationary within those gaps.

As noted, these and other problems are addressed in the system and method of the invention, including by using a lower envelope method for updating the noise threshold. This approach can also help in updating the noise threshold following a steep transition, but may involve a longer delay than the short term power stationarity test described above. On the other hand it does not require that the noise power becomes stationary following the transition.

C. System and Method of the Invention Including Using Lower Envelope for Updating Noise Threshold As explained above, one significant problem addressed by the invention is that of how to update the noise threshold when the input noise level increases during and between closely spaced speech utterances. In such a situation, if the noise threshold, $Th_\lambda$, is not properly updated, the VAD 20 will continue to decide that speech is present, although it is not, until the power stationarity test is satisfied.

The noise threshold approach of the invention is based in part on the observation that the power level of the input signal decreases even during short gaps in the speech signal (e.g., between words and particularly between sentences) to the level of the noise. Hence, if the lower envelope of the signal power is properly tracked, the noise threshold can be properly updated to the new level at the end of an utterance. Advantage is taken of the fact that for the purpose of detecting speech absence, a proper update of the noise threshold only needs to be done at the end of an utterance and not necessarily while speech is present. This may not be the case in speech enhancement systems where the knowledge of the noise level (and its spectral shape) in every segment during the speech utterance is important, as it directly affects the noise attenuation applied in each segment. Since this is a rather difficult task, and typically the noise does not vary that much during an utterance (except for transitions), updating the noise in the gaps between utterances is usually satisfactory and is commonly done. The VAD 20 however should properly detect the end of utterances, which is one problem addressed by the invention.

Figure 4:
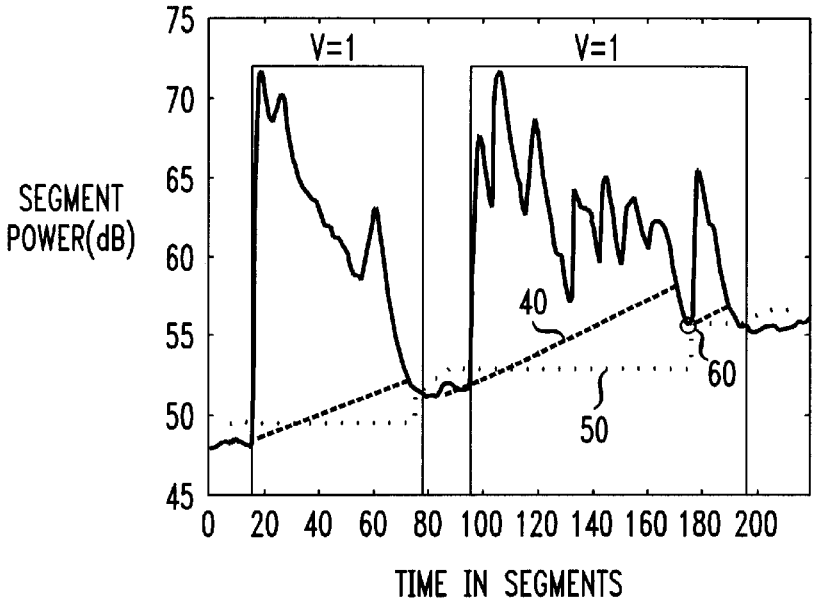
FIG. 4 illustrates the use of a lower envelope to update the noise threshold according to the invention.

An illustration of the basic lower envelope approach used in the invention is shown in FIG. 4. This figure reflects two sentences in white noise whose power increases in time at the rate of about 1 dB/sec. The initial SNR value is about 15 dB. As in FIG. 2, the thin solid line is the smoothed input signal power, $Y_m^s$, the dotted line is the noise threshold ($Th_\lambda$) 50 used by the VAD 20 according to Equation (5). The dashed line is the lower envelope 40, a signal which is used to indicate the instants at which the value of $Th_\lambda$ should be updated. In the illustrative time domain VAD 20 the value of the lower envelope 40 at an update instant is used as the value to which the noise threshold 50 is updated to, but this need not be the case in VADs which use the spectral shape of the noise.

The approach is that an update of the noise threshold 50 is performed only at those segments for which the VAD's last decision was V=1 (speech present) and the lower envelope 40 is at an inflection point 60, that is, turning up (following a segment at which the envelope was nonincreasing). The inflection point 60 is chosen because it potentially indicates that the lower envelope 40 has reached the noise level, as for instance illustrated in FIG. 4 towards the end of the second utterance (around segment 175). Updating the noise threshold 50 at inflection point 60 of the lower envelope 40 before the end of the utterance does not necessarily reflect the actual noise level within the utterance. It does however help in reaching the proper noise threshold value at the end of the utterance, or shortly after it.

Figure 5:
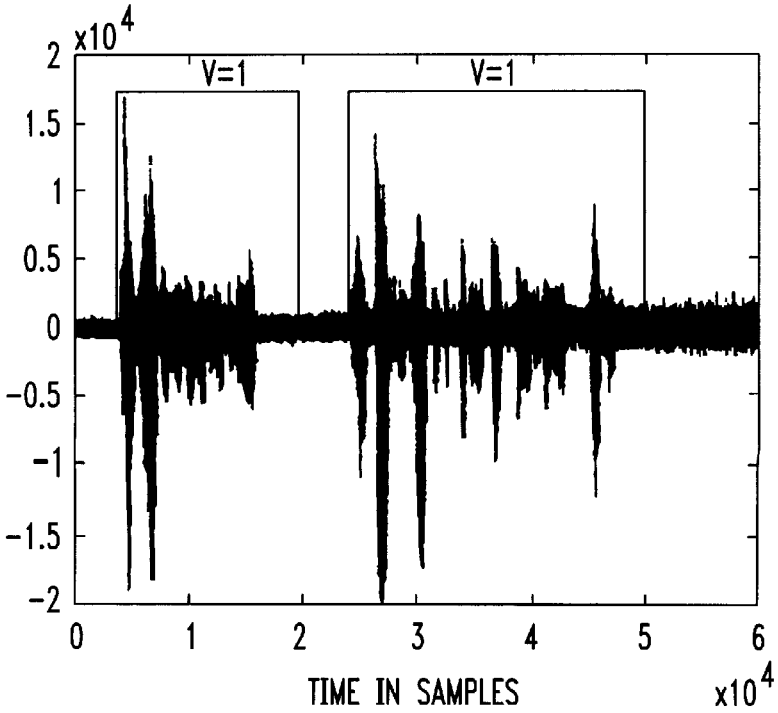
FIG. 5 illustrates the wave form of two spoken sentences in a white noise ramp with superimposed VAD decisions according to the invention.

Clearly, as shown in FIG. 4 the VAD 20 decides that speech is present (V=1) at all those segments where the input power level is above the dotted line. This is indicated by the superimposed rectangular pulses. In addition, the value V=1 is kept for 3 more segments (corresponding to $T_{hngovr}$ 96 msec) beyond the crossover point between the input power and the noise threshold 50 at the end of the utterance, due to the hangover condition discussed above. Decisions of VAD 20 for this example are shown superimposed on the input waveform in FIG. 5. It is seen that the VAD 20 performs adequately, in spite of the increase in noise level, by well beyond the factor $b_\lambda$=1.3 (~1.2 dB) while speech is present.

The value of lower envelope 40 at the mth segment, $L_E(m)$, is generated according to the following expression:

$$L_E(m) = \begin{cases} r_E L_E(m-1) & \text{if } Y_m^s > L_E(m-1) \\ Y_m^s & \text{otherwise,} \end{cases} \qquad \text{Equation 12}$$

where $r_E$>1 is the lower envelope rate-factor.

The value of lower envelope 40, $L_E(m)$, is used here to conditionally update the noise threshold according to:

$$\text{If } \{V(m-1)=1 \ \& \ HNG(m-1)=0\} \ \& \ \{L_E(m)>L_E(m-1) \ \& \ L_E(m-1)\leq L_E(m-2)\}, \text{ set } Th_\lambda(m)=L_E(m). \qquad \text{Equation 13}$$

Otherwise, the earlier value of $Th_\lambda$ is kept.

Again, HNG is the hangover flag. The condition in Equation (13) states that an update is performed if the lower envelope 40 is at an inflection point 60, provided that the last decision of VAD 20 is that speech is present (V=1, but not in a 'hangover' state). The decision of VAD 20 for the current segment (m) is then performed according to Equation (5), except that if the conditional update, according to Equation (13), is performed at segment m, V(m) is set to 1.

A significant issue in the implementation of the invention is the selection of the lower envelope rate factor $r_E$ (Equation (12)). On one hand, $r_E$ should be less than the rate of increase of the speech signal at the onset of each part of the utterance when the noise is stationary. This later rate is typically lower towards the end of an utterance than at its onset. In addition, it gets lower as the noise level in which the signal is immersed gets higher. Hence, to accommodate these requirements, adaptation in setting the value of $r_E$ is desirable, and is described below.

D. Supplementing Invention with Power Stationarity Test

As mentioned above, the lower envelope approach implemented in the invention can be effective in updating the noise threshold 50 after the occurrence of a steep increase in the noise level due to a transition like the one shown in FIG. 2. However, this processing may involve a longer delay than the conventional power stationarity test. The reason is that the rate of increase (slope) of the lower envelope 40 is limited to match, on average, the expected increase of a speech signal. Since the VAD 20 assumes during a steep transition that speech is present, the lower envelope 40 will satisfy the conditions for an update (according to Equation (13)) only after a relatively long delay. Hence, it would be of advantage to apply this supplemental test to the invention, at least under certain circumstances. This can be done by first applying the power stationarity test in each segment, and whenever it results in an update of the noise threshold 50 (according to Equation (10)), forcing the lower envelope 40 to the value of the input power. That is, what needs to be added to Equation (10) is:

$$\text{set } L_E(m)=Y_m^s \text{ if the condition in Equation (10) holds.} \qquad \text{Equation 14}$$

Figure 7:
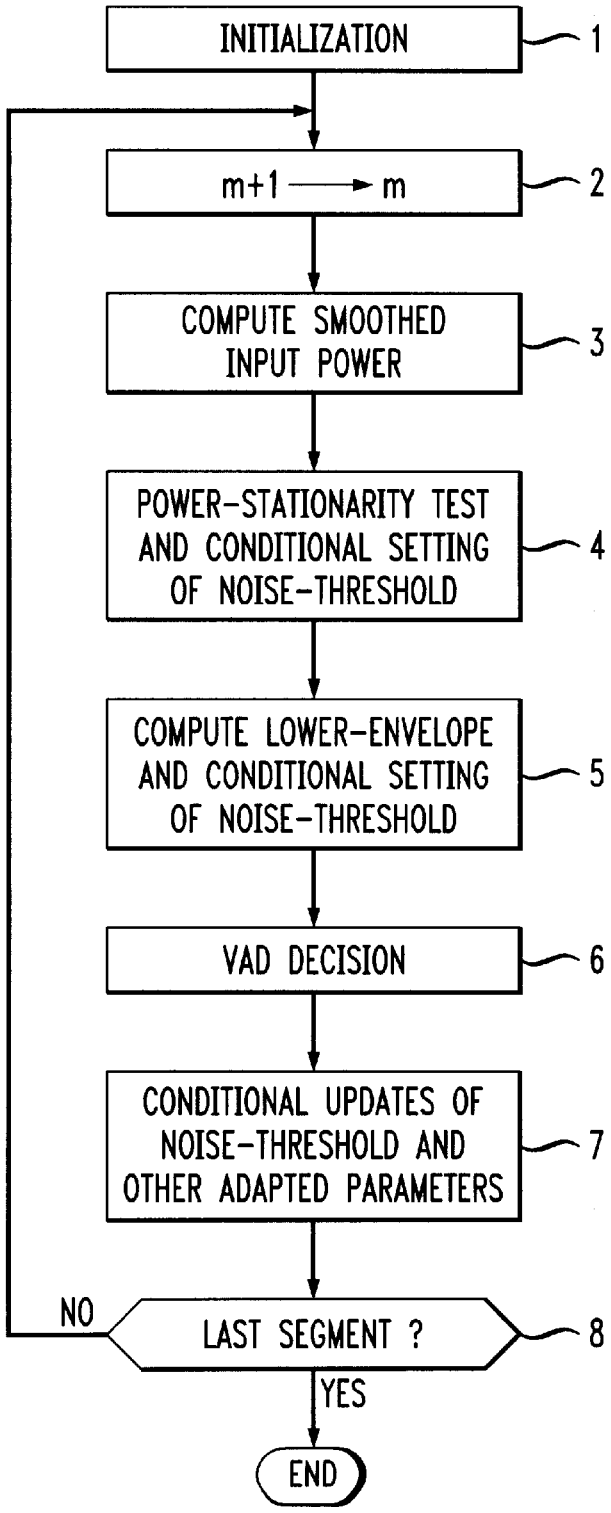
FIG. 7 illustrates a flowchart of lower envelope and noise threshold generation according to the invention.

Equation (14) precedes therefore the operations performed according to Equation (12) and (13), which are then followed by the operation of Equation (5). A schematic flow chart of that sequence is shown in FIG. 7.

Figure 6:
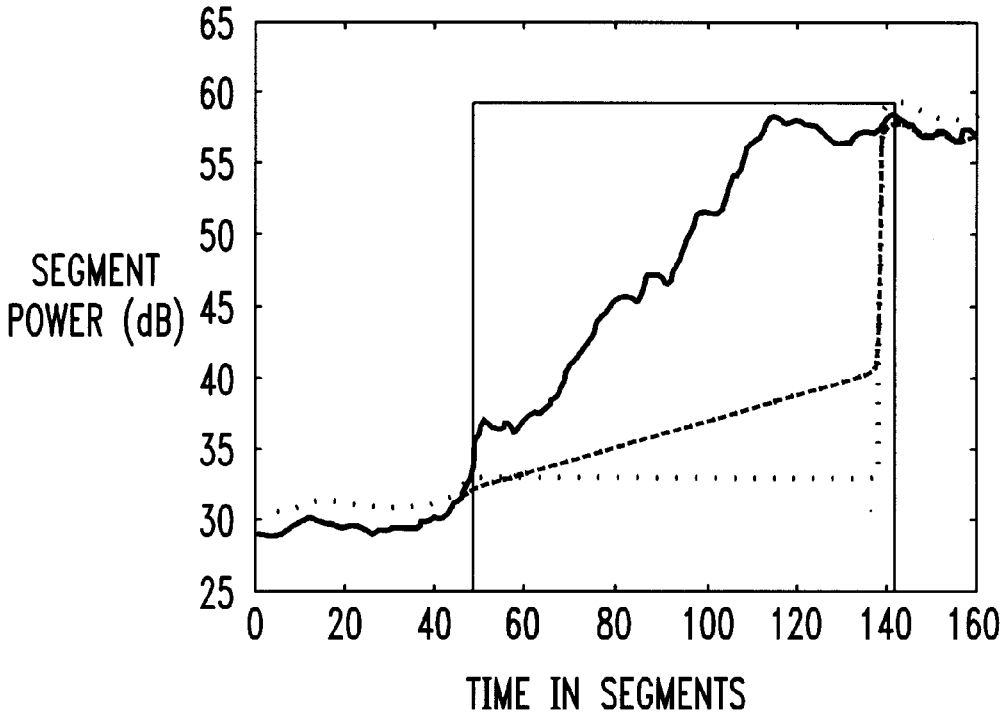
FIG. 6 illustrates the combination of the power stationarity test with lower envelope tracking according to the invention.

The combination of these approaches is shown in FIG. 6, which adds the lower envelope (dashed line) 40 to FIG. 2, and the effect of Equation (14). This figure also indicates that without the power stationarity test, the update of the noise threshold 40 would have happened later, since the slope of the lower envelope 40 is relatively low compared to the rate of increase of the transition. Furthermore, forcing the lower envelope 40 to be updated to the value of the input power after the transition ensures that VAD 20 will function as intended once a speech utterance appears. Otherwise, if a speech utterance appears before the lower envelope 40 reaches the input noise level, VAD 20 may not reach that level in time, even at the end of the utterance. Thus, the VAD 20 may not detect the end of the utterance if during the utterance there was even a small increase (beyond the factor $b_\lambda$) in noise level.

In addition, even if the power stationarity test happens to fail, e.g., because the fluctuations in noise power level following the transition are too large, the lower envelope 40 would at least eventually catch up, and the VAD 20 will recover and resume proper functioning. Otherwise this would happen only if the noise level decreases to about the level before the transition.

E. Parameter Selection and Adaptation

The implementation of the invention involves the selection of various parameters, and for some of them, like the lower envelope rate factor, $r_E$, also adaptation.

Before discussion of selection of the parameters, the issues of segment length and segment update-step are examined. The selection of these values is usually dictated by a given application. Yet, because a typical speech "quasi-stationarity" interval is limited to about 32 msec, the selection above of a segment length of duration $T_{seg}$=32 msec (corresponding to $N_{seg}$=256 samples at a sampling rate of fs=8 KHz) is taken as the nominal segment length, $T_{seg}$. Usually the segment update step $N_{step}$ is selected to be equal to the segment length $N_{seg}$. Yet, there is no reason to restrict a user to this choice. Hence, other segment length and update step values that may be used via the segment-length-ratio, $r_{seg}$, and update-step-ratio, $r_{step}$, which are defined as follows:

$$r_{seg} = \frac{T_{seg}}{T_{seg}^*}; \ r_{step} = \frac{T_{step}}{T_{seg}} = \frac{N_{step}}{N_{seg}} \qquad \text{Equation 15}$$

Consideration is now given to the parameter, $r_E$ the lower envelope rate-factor in Equation (12). According to the discussion above, one requirement for $r_E$ is that during the presence of speech its value should be within a limited range $r_E^{min} \leqq r_E \leqq r_E^{max}$. The lower value, $r_E^{min}>1$, should be selected to provide proper operation of the VAD 20 when the noise is stationary. The upper value, $r_E^{max}>r_E^{min}$, should be selected to provide the largest slope possible when the noise increases during a speech utterance. However, $r_E^{max}$ should not be too large compared to the rate of increase in the short term speech power at the low power end of the utterance. Based on simulations, the inventor has chosen the lower envelope slopes (on a logarithmic scale) to be in the range of about 1.3 dB/sec to 13 dB/sec, which for $N_{seg}=N_{step}=256$ and fs=8 KHz correspond to $1.01 \leqq r_E \leqq 1.1$. To accommodate different segment lengths and segment update-step values, the calculation is:

$$r_E^{min}=1+0.01 r_{seg} r_{step};\ r_E^{max}=1+0.1 r_{seg} r_{step} \quad \text{(Speech present)} \qquad \text{Equation 14}$$

The actual value of $r_E$ used during speech presence is set in the above range at the onset of the utterance (i.e., when V(m)=1 & V(m−1)=0) according to two other considerations. Those considerations are the rate of change of the noise power level and the noise power level itself. The rate of change in noise power level is monitored by computing at each onset of a speech utterance the ratio between the noise power value measured just before the onset and the value obtained just before the onset of the previous utterance. This ratio is denoted by $r_\lambda$, and $N_V$ represents the number of segment updates between the two measurements. These two parameters and the lowest value allowed for $r_E$, denoted above by $r_E^{min}$, are then used to determine a rate-factor value denoted by $r_E^I$, via $$r_E^I=\max(r_E^{min},(r_\lambda)^{1/N_V}) \qquad \text{Equation 17}$$

A limit is set on the value of $r_E$ which depends on the estimated value of the noise power, λ, just before the onset of the utterance, as compared to the maximal possible input power level in the system, $Y_{max}$, as given by Equation (11).

Since just before the utterance onset, $\lambda=Th_\lambda/b_\lambda$ (see Equation (3)), and $b_\lambda$ is close to 1, $Th_\lambda$ is preferably used in the following definition of the Logarithmic Noise to Peak-Signal Ratio (LNPSR):

$$P_N=log(Th_\lambda)/log(Y_{max}), 0 \leqq P_N \leqq 1, (V=0) \qquad \text{Equation 18}$$

$P_N$ is then used to obtain another rate-factor value, denoted by $r_E^{II}$, $$r_E^{II}=r_E^{min}+(r_E^{max}-r_E^{min})(1-P_N) \qquad \text{Equation 19}$$

Finally, the current value chosen for $r_E$ which is to be used through the current speech utterance is given by:

$$r_E=\min(r_E^I, r_E^{II}) \text{ (Speech Present)} \qquad \text{Equation 20}$$

This value $r_E$ is in the desired range $r_E^{min} \leqq r_E \leqq r_E^{max}$, and also takes into account both the expected increase in noise level and the noise level itself, under the above range constraints.

As noted above, the value of $r_E$ according to Equation (20) is used during the presence of the current speech utterance. Once VAD 20 has detected the end of the utterance, the value $r_E$ can be set according to the actual rate of increase of the noise power, i.e., to $$r_E=r_E^I \text{ (Speech absent)} \qquad \text{Equation 21}$$

Other parameters used in the implementation of the invention are: The hangover-interval, $T_{hngovr}$, from which $L_{hngovr}$ is computed; the smoothing factors $\alpha_Y$ and $\alpha_\lambda^{Th}$, appearing in Equation (4) and (7), respectively; the noise bias-factor, $b_\lambda$, appearing in Equation (7); and the power stationarity test-interval, $T_{PS}$ (from which $L_{PS}$ is determined), and the threshold $Th_{PS}$ appearing in the power stationarity test of Equation (9). As mentioned above, a typical value for $T_{PS}$ is 1 sec. The other parameters could also be set to fixed values. Yet, the inventor has found (and for the hangover-interval it is suggested in E. Paksoy, K. Srinivasan, and A. Gersho, "Variable Rate Speech Coding with Phonetic Segmentation," ICASSP-93, Minneapolis, pp. II-155–II-158, 1993) that there is an advantage in adapting these parameters to the noise-power level. This is done using the LNPSR, $P_N$, defined in Equation (18), according to:

$$\alpha_Y=\alpha_\lambda^{Th}=1-[\delta_0+\delta_1(1-P_N)]r_{seg}r_{step} \qquad \text{Equation 22}$$

where, based on simulations, selection is made of $\delta_0=\delta_1=0.2$.

The motivation for this adaptation is that as the noise level increases it is of advantage to have more smoothing, which is achieved by making the smoothing factor closer to 1. For the nominal values of $r_{seg}=r_{step}=1$, and since $P_N$ is between 0 (no noise) and 1, the values of the smoothing factors are in the range of 0.6 to 0.8. If a fixed value is desired, the preferred value is 0.7.

The adaptation of the hangover interval is done according to:

$$L_{hngovr}=[L_{hngovr}^{min}(1+2P_N)], \qquad \text{Equation 23}$$

where $L_{hngovr}^{min}$ is the minimum number of hangover segments (very low noise case), obtained from the minimum hangover-interval $L_{hngovr}^{min}$ via $L_{hngovr}^{min}=\lfloor T_{hngovr}^{min}/T_{step}\rfloor$. The inventor has used $T_{hngovr}^{min}=64$ msec. With $T_{step}=32$ msec, $L_{hngovr}$ can vary from 2 to 6, depending on the noise level, via $P_N$.

As for the remaining two parameters, in practice values have been used according to:

$$b_\lambda=1.6-0.5P_N \rightarrow 1.1<b_\lambda \leqq 1.6$$

$$Th_{PS}=2-P_N \rightarrow 1<Th_{PS} \leqq 2 \qquad \text{Equation 24}$$

The need for adapting these two parameters comes from the fact that as the noise level increases, the margin of speech power level above the noise decreases. Hence, to avoid 'speech clipping' (i.e., deciding V=0) of low-power speech segments, $b_\lambda$ should be reduced. As for $Th_{PS}$, it should be reduced then as well since otherwise low level speech power (above the noise) could meet the power stationarity test and cause an undesired update of the noise threshold 50.

The above adaptation is performed only when speech is absent (V=0), because only then is the value of $P_N$ updated (see Equation (18)).

With the above setting of parameters the inventor has obtained good performance down to about 0 dB SNR, as demonstrated below.

F. Algorithm Summary and Simulation Results

Before presenting simulation results, the main processing steps in the execution of the invention is presented, in conjunction with FIG. 7.

1. Initialization:
   (i) Given the sampling frequency $f_s$ and the number of bits, $N_B$, in the input signal representation, set or compute (the relevant equation numbers appear in parenthesis; the arrow, →, denotes "from which, compute") the following parameters:

$T_{seg}$ (→$N_{seg}$,$r_{seg}$(15)); $T_{step}$ (→$N_{step}$, $r_{step}$ (15)); $\delta_0$, $\delta_1$(22); $Y_{max}$(11);

$r_E^{min}$,$r_E^{max}$(17); $r_E^1=r_E^{min}$;$T_{hngovr}^{min}$(→$L_{hngovr}^{min}$) (23); $T_{PS}$(→$L_{PS}$).

(ii) Set m=1 (first segment; assumed to be "noise only").

Compute $Y_m$ (1) and set $Y_m^s=Y_m$, $Th_\lambda(m)=Y_m^s$, $L_E(m)=1$.

Set VAD decision to V(m)=0.

Compute $P_N$(18), $\alpha_Y$, $\alpha_\pi^{Th}$, (22), $b_\lambda$(23), $Th_{PS}$(24) and set $r_E=r_E^I$.

Compute updated noise threshold, for use in the next segment, $Th_\lambda(m+1)$(7).

2. Increment value of m by one.
3. Compute $Y_m$(1), $Y_m^s$ (4), and update power-stationarity buffer $B_Y$ (8).
4. Perform power stationarity test (9).
   If the condition in (10) is satisfied, set $Th_\lambda(m)=b_\lambda Y_m^s$ and $L_E(m)=Y_m$ (14).
5. Update the lower-envelope $L_E(m)$ (12).
   If the condition in (13) is satisfied set $Th_\lambda(m)=L_E(m)$.
6. Obtain VAD decision, V(m), from (5). However, if the condition in (13) is satisfied set V(m)=1.
   If V(m)=0, check if hangover should be applied. If in hangover state, set flag HNG(m)=1 and V(m)=1; otherwise, HNG(m)=0.
7. Conditional updates:
   (i) If V(m)=0, compute updated noise-threshold $Th_\lambda$ (m+1) (7).
   (ii) If V(m)=1 & V(m−1)=0 (speech onset) update $r_E$ according to (20).
   (iii) If V(m)=0 & V(m−1)=1 (end of utterance) update $r_E$ according to (21);
   update $P_N$(18); $\alpha_Y$, $\alpha_\lambda^{Th}$ (22); $L_{hngovr}$ (23); and $b_\lambda$, $Th_{PS}$ (24).
8. If last segment was reached: END. Otherwise, go to step 2.

The corresponding schematic flow chart is given in FIG. 7, with blocks in the figure being numbered according to the above steps.

In the simulation results below the above VAD 20 assumes that the input speech has no DC offset or very low frequency components. If the speech does have such components, the input signal should be high-pass filtered (or passed through a notch filter with a notch at DC), prior to processing by the above algorithm, as is a common practice in VAD systems (see ETSI-GSM Technical Specification: Voice Activity Detector, GSM 06.32 Version 3.0.0, European Telecommunications Standards Institute, 1991, ITU-T, Annex A to Recommendation G.723.1: Silence Compression Scheme for Dual Rate Speech Coder for Multimedia Communications Transmitting at 5.3 & 6.3 Kbit/s, May 1996, ITU-T, G.729A: A Proposal for a Silence Compression Scheme Optimized for the ITU-T G.729 Annex A speech coding Algorithm, by France Telecom/CNET, June 1996, each incorporated by reference).

G. Simulation Results

The principles of the system and method of the invention were programmed in MATLAB, and run on noisy speech files. Both the run time and the number of flops (floating point operations/sec) were recorded. The computational load was found to be relatively small. For all the simulations run, less than 18000 flops/sec were needed, i.e., less than 600 flops/segment (for a segment length of 256 samples at 8 KHz sampling rate). On a commercially available SGI Indy workstation the invention ran faster than real time by a factor of at least 2.

Figure 8:
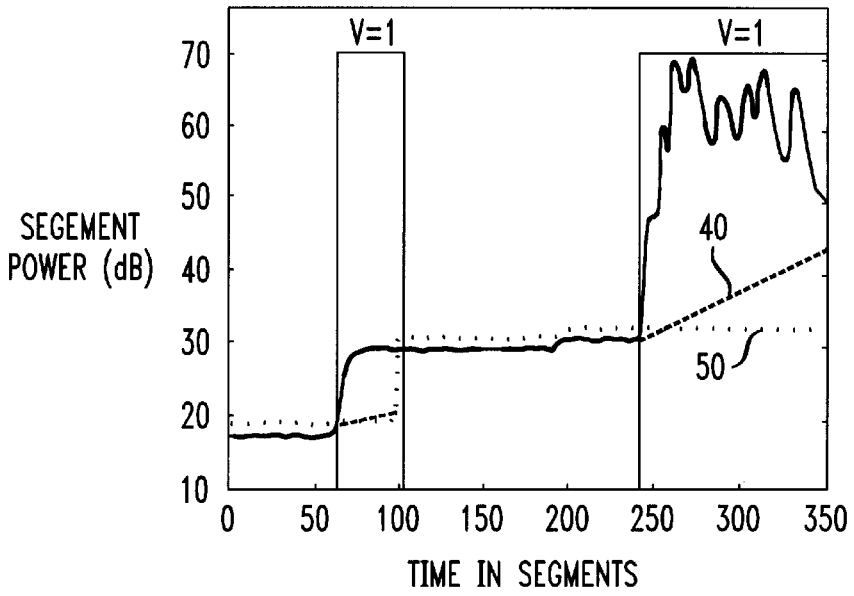
FIG. 8 illustrates VAD output for tape hiss transition followed by music and speech according to the invention.
Figure 9:
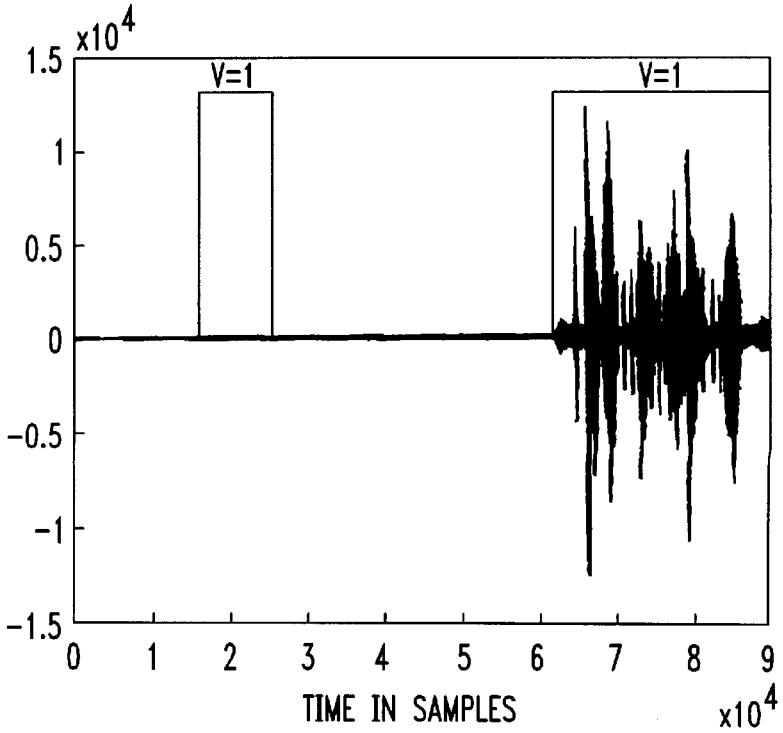
FIG. 9 illustrates a waveform of tape hiss transition followed by the onset of music and speech according to the invention with superimposed VAD decisions according to the invention.

As another demonstration of the operation of the invention in the presence of a noise transition, FIG. 8 shows the processing results for a signal obtained from a tape recorder, where before the recorded signal (music and speech) begins, and tape hiss level suddenly increases (around segment 60 in the figure). The power stationarity test causes an update of the noise threshold 50 (dotted line) around segment 100 (along with an update of the lower envelope 40 shown by the dashed line). The recorded signal onset occurs around 240. Even without the power stationarity update mechanism the lower envelope 40 would have resulted eventually in an update of the noise threshold 50 (once it meets the signal power envelope). However, because of its low slope this would have happened later, beyond the range shown in this figure. In such a case the VAD 20 would have emitted the decision V=1 through segments 100 to 240 as well. FIG. 9 shows the input signal waveform with the VAD decisions superimposed on it.

Figure 10:
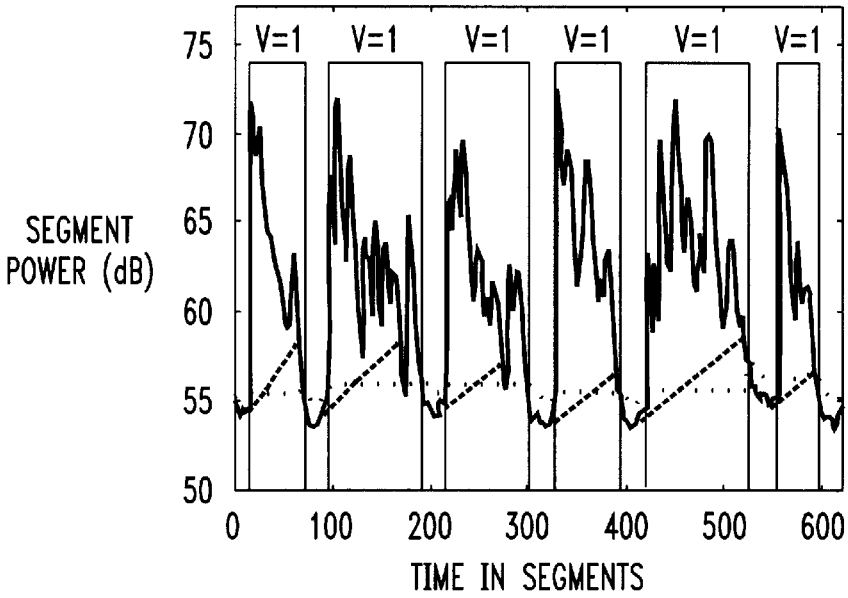
FIG. 10 illustrates VAD output for spoken sentences in car noise according to the invention.
Figure 11:
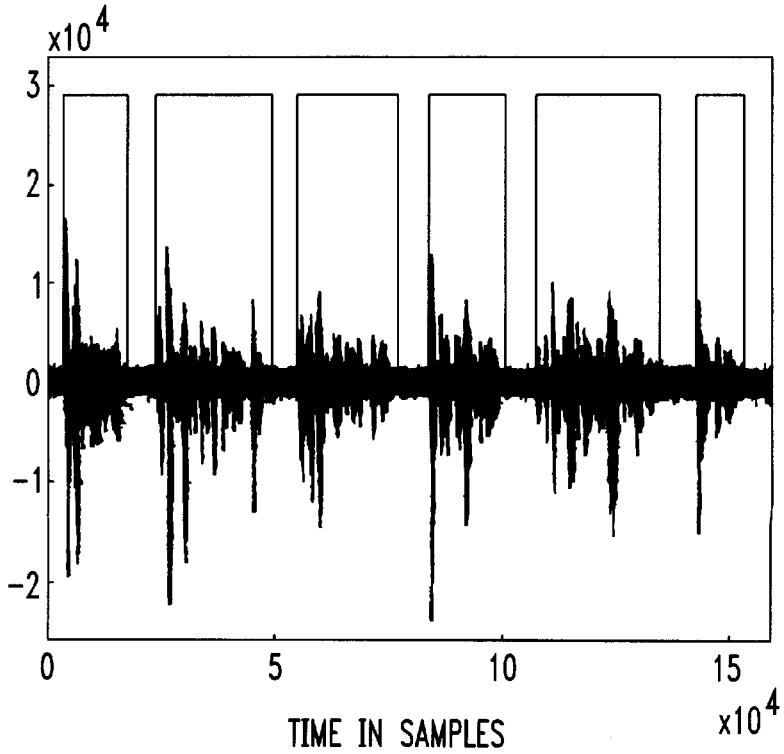
FIG. 11 illustrates a waveform of six sentences in car noise with superimposed VAD decisions according to the invention.

The inventor has examined the operation of the invention at different input noise levels, as well. FIG. 10 shows results obtained for 6 sentences in car noise at an SNR of 10 dB. The corresponding waveform (with superimposed decisions of VAD 20) is also shown in FIG. 10. In spite of fluctuations of the noise level the lower envelope 40 used in the invention facilitates a proper update of the noise threshold 50, and the decisions of VAD 20 are correct. At some segments (e.g., around 190 and 290), the signal power envelope crosses (gets below) the noise threshold 50, but the decision of VAD 20 remains V=1. This is due to the 'hangover' which is longer (3 segments) than the short speech gap around those segments. FIG. 11 shows the corresponding waveform and superimposed decisions of VAD 20.

Figure 12:
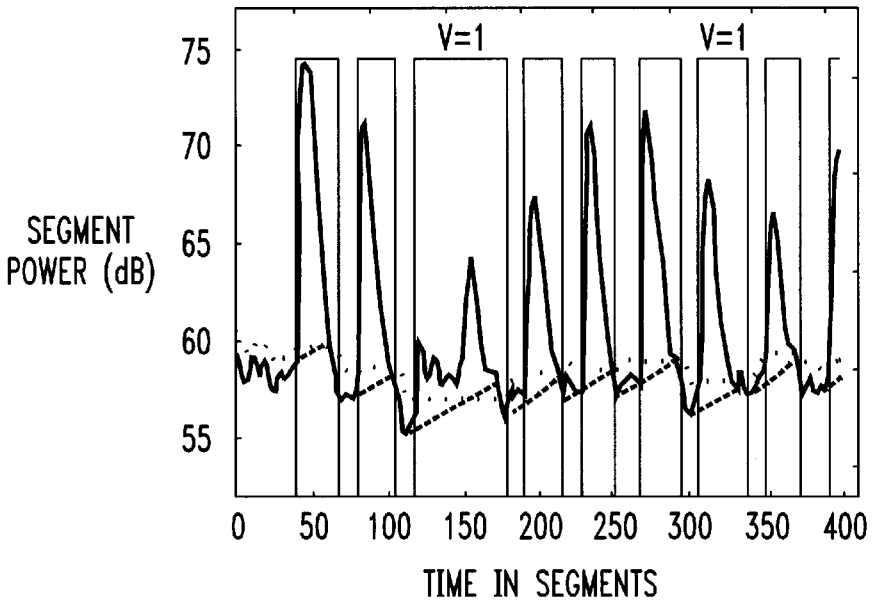
FIG. 12 illustrates VAD output for isolated spoken words in helicopter noise according to the invention.
Figure 13:
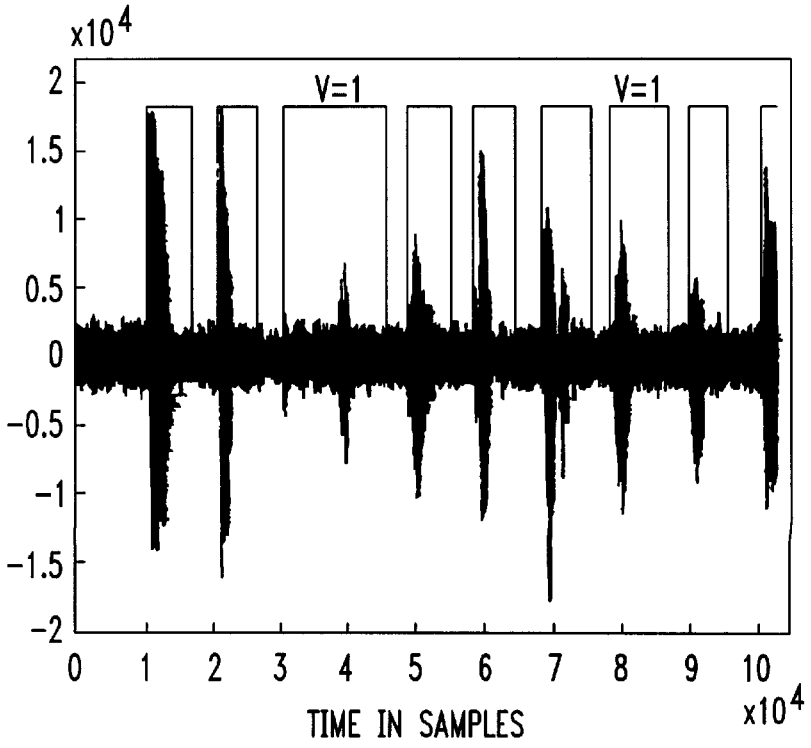
FIG. 13 illustrates the waveform of isolated spoken words in helicopter noise with superimposed VAD decisions according to the invention.

A more difficult case is demonstrated in FIG. 12. Here the noise is not only higher then in FIGS. 10 and 11 (speech in helicopter noise at 5 dB SNR), but also fluctuates more. Even here using the invention VAD 20 does not miss any speech events, which here are isolated words from a Diagnostic Rhyme Test (see also the corresponding waveform in FIG. 13). However, VAD 20 does not detect the short gap between the $3^{rd}$ and $4^{th}$ utterance (around segment 140). It may be noted that if a fixed noise threshold would have been used according to the noise power level at the initial segments (about $10^6$-corresponding to 60 dB in FIG. 12), the $3^{rd}$ utterance would have been cut out, because it has a relatively low power.

Figure 14:
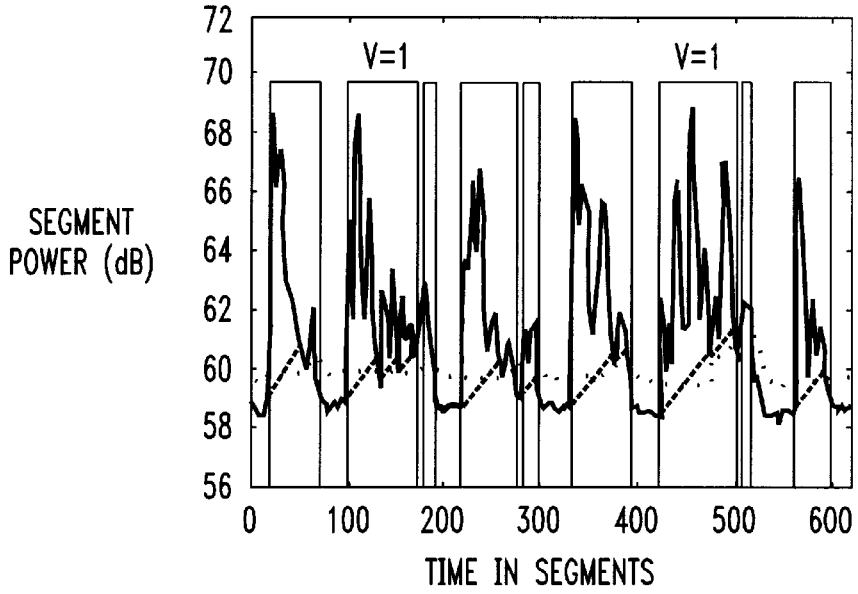
FIG. 14 illustrates VAD output for six spoken sentences in white noise according to the invention.

FIG. 14 presents the results obtained for the same six sentences of FIG. 10 in white noise at 0 dB SNR. Here too the VAD 20 operating according to the invention does not miss any speech event (see also the corresponding waveform in FIG. 15), although, because of the higher noise level, VAD 20 detects short gaps within the $2^{nd}$ sentence (around segment 175), the $3^{rd}$ sentence (around segment 275) and the $5^{th}$ sentence (around segment 500).

Figure 15:
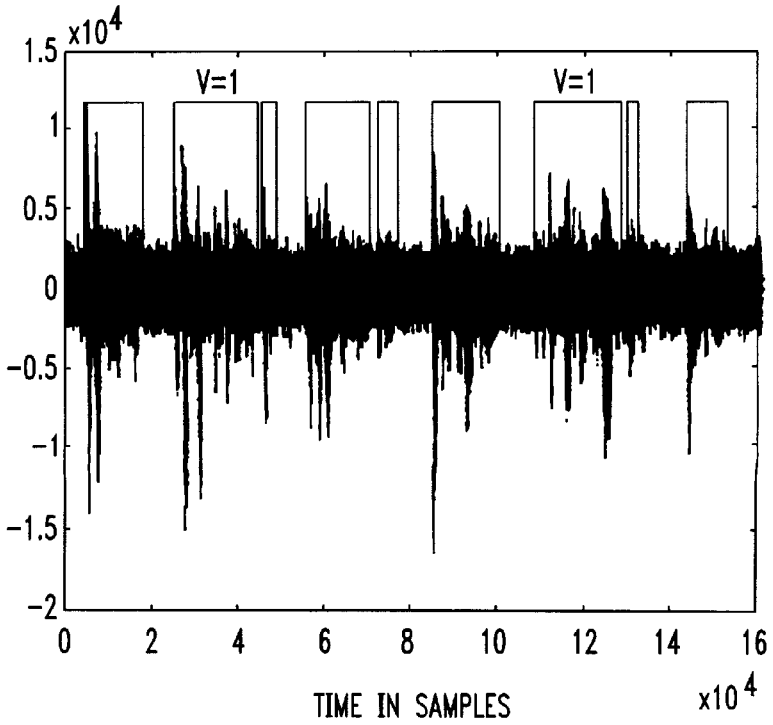
FIG. 15 illustrates a waveform of six spoken sentences in white noise with superimposed VAD decisions according to the invention.

In all the above examples an output signal has been produced in which segments for which the decision of VAD 20 was V=0 (speech absent) were zeroed out. By listening to this output signal the inventor subjectively considered whether the speech itself was clipped. In all the examples no harm was done to the speech, except for the case of 0 dB SNR, where there were a few segments of low level speech which were clipped. In the example of FIGS. 14 and 15, this happens only in the $5^{th}$ sentence around segment 500. Hence it appears that the time domain VAD implementation of the invention is suitable for operation down to about 0 dB SNR.

The foregoing description of the system and method for noise threshold adaptation for voice detection of the invention is illustrative, and variations in construction and implementation will occur to persons skilled in the art. For instance, while the invention has been described in terms of a low-complexity time domain VAD implementation, other configurations including frequency-domain systems could be used. The scope of the invention is accordingly only intended to be limited by the following claims.

What is claimed is:

1. A method for updating a noise threshold used for detecting the presence of a signal in an input signal having noise, comprising the steps of:

obtaining a detection signal indicating whether the signal is present in a prior period;

obtaining a lower envelope signal for a current period;

obtaining a noise threshold signal for the current period; and updating the noise threshold signal to equal the lower envelope signal when the detection signal is positive, and the lower envelope signal is at an inflection point.

2. The method of claim 1, wherein the signal is embedded in an input signal, further comprising the steps of:

obtaining a power signal indicating the power of the input signal, and the step of obtaining a lower envelope for a current period comprises the step of updating the lower envelope for the current period to equal the power signal for the current period if the lower envelope signal for a prior period is less than or equal to the power signal for the current period, and updating the lower envelope for the current period to equal to the lower envelope for a prior period times a rate factor, otherwise.

3. The method of claim 1, wherein the step of determining whether the lower envelope signal is at an inflection point comprises the step of obtaining a lower envelope signal for a prior period, and comparing the lower envelope signal for a prior period to the lower envelope signal for the current period to determine if the lower envelope is turning up after a local minimum.

4. The method of claim 1, wherein the step of obtaining a detection signal comprises the step of determining whether the signal is present using hangover delay information.

5. The method of claim 1, further comprising the step of outputting a positive detection signal if the input signal exceeds the updated noise threshold signal.

6. The method of claim 1, wherein the signal is a voice signal.

7. The method of claim 2, wherein the step of obtaining a power signal comprises the step of computing a smoothed power signal of the input signal over at least two periods.

8. The method of claim 2, wherein the rate factor is set to be less than a rate of increase of the signal at the onset of the signal when the noise is stationary, and is adjusted to decrease when the noise increases.

9. The method of claim 5, further comprising the step of applying a power stationarity test in addition to testing the input signal against the noise threshold signal, and outputting a positive detection signal only if the power stationarity test is also satisfied.

10. The method of claim 6, wherein the step of applying a power stationarity test comprises the step of determining a ratio of the largest and smallest values of a power signal indicating the power of the input signal over a predetermined number of periods.

11. The method of claim 9, wherein the signal is embedded in an input signal, further comprising the steps of:

obtaining a power signal indicating the power of the input signal, and the step of obtaining a lower envelope for a current period comprises the step of updating the lower envelope for the current period to equal the power signal for the current period if the power stationarity test for the prior period is not satisfied and the power stationarity test for the current period is satisfied, and the detection signal for the prior period is positive.

12. A system for updating a noise threshold use for detecting the presence of a signal in an input signal having noise, comprising:

an input unit for receiving the input signal in which the signal is embedded;

a processing unit, the processing unit connected to the input unit, the processing unit;

obtaining a detection signal indicating whether the signal is present in a prior period, obtaining a lower envelope signal for a current period, obtaining a noise threshold signal for the current period, and updating the noise threshold signal to equal the lower envelope signal when the detection signal is positive and the lower envelope signal is at an inflection point.

13. The system of claim 12, wherein the processing unit obtains a power signal indicating the power of the input signal, and updates the lower envelope for the current period to equal the power signal for the current period if the lower envelope signal for a prior period is less than or equal to the power signal for the current period, and updates the lower envelope for the current period to equal to the lower envelope for a prior period times a scaling factor, otherwise.

14. The system of claim 12, wherein the processing unit determines whether the lower envelope signal is at an inflection point by obtaining a lower envelope signal from a prior period, and comparing the lower envelope signal for the prior period to the lower envelope signal for the current period to determine if the lower envelope is turning up after a local minimum.

15. The system of claim 12, wherein the processing unit obtains the detection signal using hangover delay information.

16. The system of claim 12, wherein the processing unit detects the presence of the signal if the input signal exceeds the updated noise threshold signal.

17. The system of claim 12, wherein the signal is a voice signal.

18. The system of claim 13, wherein the processing unit obtains the power signal by computing a smoothed power signal of the input signal over at least two periods.

19. The system of claim 13, wherein the rate factor is set to be less than a rate of increase of the signal at the onset of the signal when the noise is stationary, and is adjusted to decrease when the noise increases.

20. The system of claim 16, wherein the signal is embedded in an input signal, the processing unit further:

obtaining a power signal indicating the power of the input signal, and obtaining the lower envelope for the current period by updating the lower envelope for the current period to equal the power signal for the current period if the power stationarity test for the prior period is not satisfied and the power stationarity test for the current period is satisfied, and the detection signal for the prior period is positive.

21. The system of claim 16, wherein the processing unit applies a power stationarity test in addition to testing the input signal against the noise threshold signal, and outputs a positive detection signal only if the power stationarity test is also satisfied.

22. The system of claim 21, wherein the processing unit applies the power stationarity test by determining a ratio of the largest and smallest values of a power signal indicating the power of the input signal over a predetermined number of periods.

* * * * *